US006935734B2

(12) United States Patent
Askren et al.

(10) Patent No.: US 6,935,734 B2
(45) Date of Patent: Aug. 30, 2005

(54) APPARATUS AND METHOD FOR PRINTING USING A COATING SOLID

(75) Inventors: Benjamin A. Askren, Lexington, KY (US); Ronald W. Baker, Versailles, KY (US); Ligia Aura Bejat, Versailles, KY (US); Charles J. Cheek, Versailles, KY (US); Gerald L. Fish, Versailles, KY (US); Hrishikesh Pramod Gogate, Lexington, KY (US); Bhaskar Gopalanarayanan, Lexington, KY (US); Jason Gordon, Nicholasville, KY (US); Philip J. Heink, Lexington, KY (US); John W. Kietzman, Lexington, KY (US); Michael C. Leemhuis, Nicholasville, KY (US); Claudia A. Marin, Lexington, KY (US); Sean D. Smith, Lexington, KY (US); Donald W. Stafford, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 48 days.

(21) Appl. No.: 10/453,138

(22) Filed: Jun. 3, 2003

(65) Prior Publication Data

US 2004/0246318 A1 Dec. 9, 2004

(51) Int. Cl.[7] ..... B41J 2/01
(52) U.S. Cl. ..... 347/101; 347/103; 347/96
(58) Field of Search ..... 347/101, 103, 347/96, 100; 399/1; 400/1

(56) References Cited

U.S. PATENT DOCUMENTS

| | | | | |
|---|---|---|---|---|
| 4,421,816 | A | | 12/1983 | Arnold |
| 4,992,304 | A | | 2/1991 | Titterington |
| 5,006,862 | A | | 4/1991 | Adamic |
| 5,211,747 | A | | 5/1993 | Breton et al. |
| 5,389,958 | A | | 2/1995 | Bui et al. |
| 5,496,634 | A | | 3/1996 | Ogawa et al. |
| 5,652,019 | A | | 7/1997 | Moran |
| 5,677,719 | A | | 10/1997 | Granzow |
| 5,805,191 | A | | 9/1998 | Jones et al. |
| 5,837,042 | A | | 11/1998 | Lent et al. |
| 5,959,056 | A | | 9/1999 | Beach et al. |
| 5,973,025 | A | | 10/1999 | Nigam et al. |
| 6,059,407 | A | | 5/2000 | Komatsu et al. |
| 6,156,072 | A | | 12/2000 | Usui et al. |
| 6,161,929 | A | | 12/2000 | Erdtmann et al. |
| 6,183,079 | B1 | | 2/2001 | Meade et al. |
| 6,196,674 | B1 | | 3/2001 | Takemoto |
| 6,214,279 | B1 | | 4/2001 | Yang et al. |
| 6,293,668 | B1 | | 9/2001 | Kubby et al. |
| 6,460,973 | B1 | * | 10/2002 | Takahashi et al. ..... 347/55 |
| 2001/0022607 | A1 | * | 9/2001 | Takehashi et al. ..... 347/103 |
| 2003/0068571 | A1 | * | 4/2003 | Uehara et al. ..... 347/101 |

FOREIGN PATENT DOCUMENTS

| | | |
|---|---|---|
| WO | WO 01/53070 A1 | 7/2001 |
| WO | WO 01/53071 1 | 7/2001 |

* cited by examiner

*Primary Examiner*—Manish S. Shah
(74) *Attorney, Agent, or Firm*—John A. Brady

(57) ABSTRACT

An apparatus for ink-jet printing including an ink-jet print head to jet ink, a coating solid, and a coating holder to support the coating solid, wherein the coating holder transfers a portion of the coating solid onto a medium to form a coating solid layer. The coating holder and coating solid may be combined in a removable cartridge. In addition, the medium may be an intermediate transfer medium, a media support medium, a transfer medium, or media, such as paper. A method for inkjet printing also includes applying a coating solid to a medium to form a layer of the coating solid, in a solid form, having predetermined thickness, and applying ink to the medium. The layer of coating solid may interact with the applied ink to destabilize colorant in the ink.

5 Claims, 16 Drawing Sheets

APPARATUS AND METHOD FOR PRINTING USING A COATING SOLID

BACKGROUND OF THE INVENTION

1. Field of the Invention

The present invention relates to a system and method for printing an image onto a medium using a coating solid to interact with the printed image. More particularly, the present invention relates to an inkjet printer system including inkjet printing and coating a solid onto a medium to improve print quality and image release when the coating solid interacts with the jetted ink.

2. Description of the Related Art

FIG. 1 illustrates an example of a conventional inkjet printer, including inkjet printer 10 having a platen or tray for receiving media, such as paper, a carriage 15 to carry ink cartridge(s) 17, and a processor 20 to control the operation of inkjet printer 10. As illustrated in FIG. 1, carriage 15 carries ink cartridge(s) 17 across media or potentially axially across an intermediate transfer medium (ITM) 40, as further illustrated in FIG. 2. In FIG. 2, an ink cartridge travels across ITM 40 while printing onto ITM 40 in spiraled swaths, i.e., helical printing. Once the printing to ITM 40 has completed, media 30 is compressed between a nip generated at the intersection of ITM 40 and roller 45, thereby transferring the image printed on ITM 40 to media 30.

Although the example illustrated in FIG. 2 shows helical inkjet printing onto ITM 40, many alternative techniques are also available, such as printing directly to media 30, without an ITM, or printing onto media 30 while mounted on a media support medium.

FIG. 2 also illustrates that a liquid coating may be applied to the surface of ITM 40. The liquid coating is used to improve print quality, as well as release and transfer of an image from an ITM to media. To provide the improved image quality, liquid coating compositions may destabilize a colorant in ink prior to penetration into the media. The colorant in ink might be dyes, pigments, or other materials, depending on the chemical structure of the ink. Similarly, the liquid coating composition is designed to interact with a corresponding ink. For example, the liquid coating may be a flocculent, such as a liquid that contains a multivalent salt or is low pH, which may be applied to the media or ITM before, during, or after the jetting of ink. When the ink impacts the flocculent, the colorant in the ink destabilizes, thereby preventing penetration of the colorant into the media while allowing penetration of the remaining ink constituents. In another example, media can be pre-coated with a liquid composition that contains a flocculent. Further, in this example, a mordant may also be added to the liquid composition to reduce spreading and color-to-color bleeding of the ink.

The coating material is only applied and resident on the media or ITM in a liquid form, which thereby introduces extra water into the media. In addition, a liquid coating composition may increase paper cockle, and a coat thickness can easily vary by more than 100%.

Depending on the viscosity of the fluid coating material, the application of a uniform layer of a particular thickness of fluid can be very difficult to accomplish. If the coating fluids are very thin, then foam rolls or felt wicks can be used to apply coatings. Very thin fluids can also be jetted via inkjet-like print heads. If fluids are thicker or of a higher viscosity (to allow the use of chemicals which provide bigger print quality improvements or more rapid ink absorption effects), then more complicated application methods such as blade coating or roll coating become necessary. These methods are challenged to obtain uniform coatings at reasonable power consumptions, especially at process speeds desirable for ITM printing applications. It is especially difficult to distribute fluid uniformly across the width of a page-wide blade coater in order to produce a uniform coating. On the other hand, traveling blade coaters (those that are not page-wide) reduce throughput and increase machine width for drum printers, and are quite complicated to make operate bidirectionally. Blade coating methods also produce coating thicknesses which are highly speed dependent, which is a major limitation for printers which operate at more than one process speed (i.e. to produce outputs at different print resolutions).

In addition, the liquid coating material for ITM printers can have undesirable interactions with jetted liquid ink droplets, allowing the droplets to move or grow in size on the ITM rather than remaining fixed in place. However, the requirement to maintain flowability of the liquid coating material can limit the availability of the active chemical components, or concentration of the same, that can be included in the liquid coating material.

Examples of ITM printing systems using liquid coatings are described in U.S. Pat. Nos. 5,389,958, 5,805,191, and 5,677,719, all of which describe liquid coating material on an ITM, jetting ink onto the liquid coated surface of the ITM, and thereafter transferring the ink image to media through a nip generated by the ITM and a roller. Liquid coating systems require fluid handling hardware, including subsystems to store fluids, to move them from the storage vessel to the coating system, to apply them to an ITM, and to clean off residue after image transfer. These subsystems also have issues with fluid containment, which may restrict the orientation of printers during use or shipping. Liquid coating systems have been used to improve print quality for inkjet printers. As noted above, the liquid coatings usually interact with components of the ink, flocculating pigment particles, fixing dyes, or affecting absorption of ink components into the media, for example. Examples of such liquid coating techniques have also been illustrated in U.S. Pat. Nos. 6,183,079 and 6,196,674.

The present inventors have concluded that rather than applying liquid coatings, it would be more advantageous to apply coatings in a solid form. In addition, it is difficult to control the application of the liquid coating layers for thin even coating layers, while the application of a coating solid layer does not suffer from this limitation. Thus, a previously unknown method and apparatus for application of a coating solid layer, performing destabilization of a colorant in an ink, would appear to be necessary.

U.S. Pat. No. 6,059,407 describes a process where efficient transfer of an ink image from an ITM is accomplished with a particular applied transfer drum material and a solid surfactant. In U.S. Pat. No. 6,059,407, several different low surface energy rubber materials were used, each providing for highly efficient release of the ink image from the ITM. However, print quality defects resulted from the low surface energy of these particular rubber materials, with the ink image moving and flowing significantly on the surface of the low surface energy rubber materials. To counter this effect, this U.S. Pat. No. 6,059,407 describes applying a surfactant, in a solid form, to the surface of the drum, with the surfactant having an HLB (hydrophilic-lipophilic balance) value between 2 and 16. HLB is a reference value to compare different surfactants in a relative sense. The actual value needed would be dependent on drum surface and ink formulation. U.S. Pat. No. 6,059,407 also describes most of the classes of surfactants available.

However, the sole purpose of applying the solid surfactant in this U.S. Pat. No. 6,059,407 is to control the spread of the ink image on the surface of the ITM, caused by the unique low surface energy rubber materials. Thus, the surfactant does not aid in the transfer efficiency of the ink image to the media, e.g., performing destabilization of a colorant in an ink, but rather, merely compensates for a low surface energy aspect of the unique transfer drum materials. In addition, after application of the solid surfactant material, it would appear that the surfactant material is liquefied into a liquid layer while on the surface of the transfer drum.

Conversely, the purpose of the liquid coatings, and the inventors' coating solids, is to effect efficient transfer of ink colorant to the media. Typically, surface energy modifications are not necessary to maintain print quality. Rather, if image spread is observed, it can be modified within the ink formulation. Embodiments of the present invention may not even include any surfactant in their solid material formulations, while also noting that surfactants may not diffuse with an ink on a time scale required in printing systems to perform this destabilizing operation.

SUMMARY OF THE INVENTION

One aspect of the present invention is to provide a method and apparatus for inkjet printing and coating a solid onto a medium to improve print quality and image release when the coating solid interacts with the jetted ink.

A further aspect of the present invention is to provide a method and apparatus for printing using an inkjet print system and coating a solid onto a medium to improve print quality and image release where the coating solid interacts with the jetted ink to destabilize colorant in the ink.

Aspects and advantages of the present invention are achieved with embodiments of a ink jet printer apparatus. The apparatus includes an ink-jet print head to jet ink, a coating solid to interact with ink to destabilize colorant in the ink, and a coating holder to support the coating solid, wherein the coating holder transfers a portion of the coating solid onto a medium to form a coating solid layer.

In addition, the medium can be an intermediate transfer drum or belt, a media support medium, a transfer medium, or a medium, including paper.

The coating solid can be transferred to the medium before the medium is on a media support medium, where ink is jetted onto the medium, or the coating solid can be applied to the medium while the medium is on a media support medium.

Further, the transfer of the coating solid portion to the medium may include first applying the coating solid portion to a transfer medium, e.g., a roller or belt, with the applied coating solid then being transferred from the transfer medium to the medium. Alternatively, the jetting of ink to the medium can be performed after a corresponding portion of the medium has withdrawn from contact with the transfer medium where the coating solid is transferred to the medium.

The coating holder may also be contained in a removable cartridge, along with a cleaning blade and a waste bin.

A processor may be included in the inkjet printer to control a speed of the medium and/or a contact pressure of the coating solid to the medium to control an application thickness of the coating solid on the medium. A contact pressure of the coating solid to the medium may also be controlled to be less than 5 psi, or even less than 2 psi.

In addition, the coating holder may also contain a seal to enable sealing of the coating solid when coating is not required.

An additional coating solid may be included in the inkjet printer to form an additional coating solid layer, with a width of the coating solid layer and a width of the additional coating solid layer cooperating to generate an overall predetermined layer width on the medium. Further, the separate coating solid layers partially overlap widthwise.

Similarly, the coating solid may be one of a plurality of coating solids in the ink-jet printer, wherein one or more coating solids are used to apply the coating solid layer with a variable and/or adjustable width. In addition, the coating holder may be rotatable to change a width of the coating solid layer.

A proximity sensor may be included in the inkjet printer to determine a proximity of an end of the coating solid to the medium. Further, a detector may similarly be included to determine an amount of coating solid present in the coating holder.

The coating solid may be a gel. In addition, the coating solid layer may have a thickness of 0.1 to 10 microns, or even 0.5 to 2 microns. The coating solid may also be in a roller form or a stick form, as well as not containing a surfactant. The coating solid may also contact the medium across an area having a working face height of less than 12 mm.

The coating holder may or may not traverse across a width of the medium, as well as potentially traversing in a helical pattern.

Further aspects and advantages are achieved in accordance with embodiments of the present invention by a removable cartridge for use in a printer applying a coating solid to a medium and an ink release process, by a print head in the printer, with the cartridge including a coating holder supporting the coating solid to generate a solid layer of the coating solid on the medium, when applied to the medium, with the coating solid destabilizing colorant in ink used in the ink release process. The cartridge may also include a cleaner blade and a waste bin. Further, the working face of the coating solid may be less than 12 mm.

Other aspects and advantages are achieved in accordance with embodiments of the present invention by a method of printing within a printer, including applying a coating solid to a medium to form a layer of the coating solid, in a solid form, having predetermined thickness, applying ink toward the medium, wherein the layer of coating solid interacts with the applied ink to destabilize colorant in the ink.

The medium may be an intermediate transfer medium, a media support medium, a transfer medium, or media, such as paper. In addition, the intermediate transfer medium may have a roughness of 0.05 microns to 1.5 microns Ra.

The coating solid may be applied to the medium prior to placing the medium on a media support medium, where the ink application is performed, or while media is present on the media support medium The ink may be applied to the medium without an intermediate transfer medium or media support medium. Alternatively, the coating solid and ink may both be applied to the medium, which is an intermediate transfer medium, with another medium being made to come into contact with the intermediate transfer medium to transfer the coating solid and ink to the other medium.

A speed of the medium and/or contact pressure of the coating solid to the medium may be controlled to control the thickness of the coating solid layer. Further, the contact pressure of the coating solid to the medium may be controlled to be less than 5 psi, or even less than 2 psi.

The coating solid may be angled, such that the coating solid is arranged to be non-perpendicular to a surface of the medium at a point of contact with the medium, to control vibration and/or chatter.

Further, at least one additional coating solid layer may be applied to the medium, with a width of the coating solid layer and an overall width of the at least one additional coating solid layer cooperating to generate an overall predetermined layer width on the medium. The separate coating solid layers may also partially overlap widthwise. Similarly, the width of the coating solid layer may be changed by applying one or more coating solids, wherein the coating solid is one of the one or more coating solids. Further, a coating holder holding the coating solid may be rotated to control a width of the coating solid layer.

In addition, a friction force between the coating solid and the medium may not change a contact pressure between the coating solid and the medium when generating the coating solid layer.

The coating solid layer may similarly be controlled to have a thickness of 0.1 to 10 microns, or even 0.5 to 2 microns. In addition, the coating solid may traverse across a width of the medium to apply the coating solid layer, and potentially in a helical pattern.

Additional aspects and advantages are achieved in accordance with embodiments of the present invention by an ink jet printer including a media support medium, an ink-jet print head, and a coating holder supporting a coating solid, wherein the coating holder is operable to transfer the coating solid onto at least a portion of a medium to form a coating solid layer before movement of the medium to the media support medium, with the ink-jet print head jetting ink onto the medium while on the media support medium.

Still additional aspects and advantages are achieved in accordance with embodiments of the present invention by an ink-jet printer including a media support medium, an ink-jet print head, and a coating holder supporting a coating solid, wherein the coating holder is operable to transfer the coating solid onto a medium mounted on the media support medium to form a coating solid layer on the medium, with the ink-jet print head jetting ink for transfer of an image to the medium while mounted on the media support medium.

Further aspects and advantages are achieved in accordance with embodiments of the present invention by an ink-jet printer including an ink-jet print head, and a coating holder supporting a coating solid, wherein the coating holder is operable to transfer a layer of the coating solid onto a medium at an upstream location, to form a coating solid layer on the medium, before the ink-jet print head jets ink to the medium at a downstream location.

The inkjet printer may further include a roller to pull the medium past the upstream location, with the roller being before the downstream location.

Transfer of the layer of the coating solid onto the medium may also be performed by generating a coating solid layer on a transfer medium and transferring the coating solid layer on the transfer medium to the medium, with the transfer medium potentially being a roller with a surface roughness of 0.3 microns to 2.0 microns Ra.

In accordance with preferred embodiments of the present invention as noted above, a method and apparatus can be achieved for inkjet printing and coating a solid onto a medium that improves print quality and image release where the coating solid interacts with the jetted ink. As further noted above, conventional printing systems require the use of liquid coating solids, which are both burdensome to implement and present several quality related inadequacies. The embodiments of the present invention, as described herein, provide methods and apparatuses for implementing the use of solid coating materials to overcome these drawbacks.

BRIEF DESCRIPTION OF THE DRAWINGS

These and other aspects and advantages of the invention will become apparent and more readily appreciated for the following description of the preferred embodiments, taken in conjunction with the accompanying drawings of which.

DESCRIPTION OF THE PREFERRED EMBODIMENTS

Figure 1:
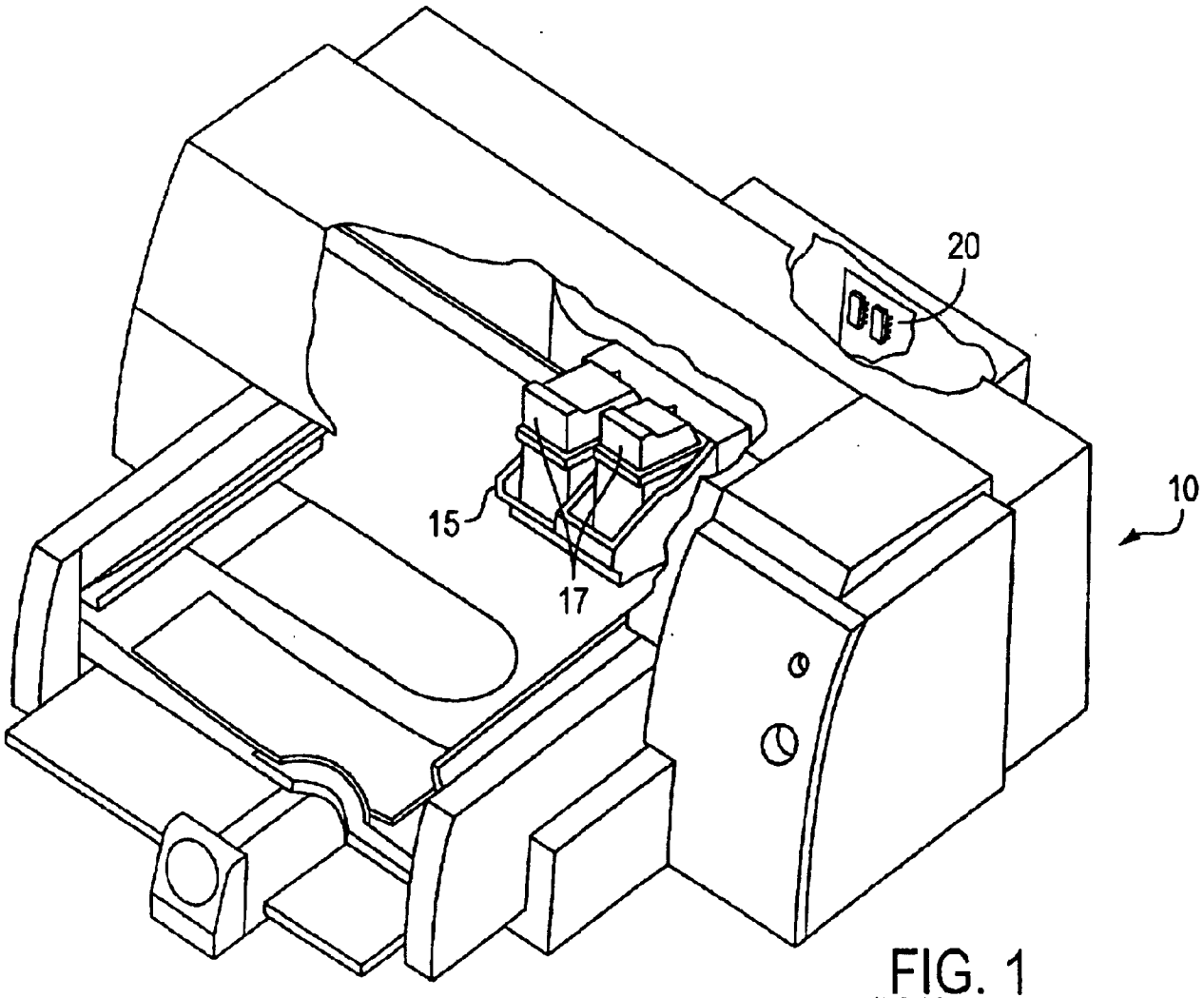
FIG. 1 (PRIOR ART)
FIG. 1 is an illustration of a conventional inkjet printer.
Figure 2:
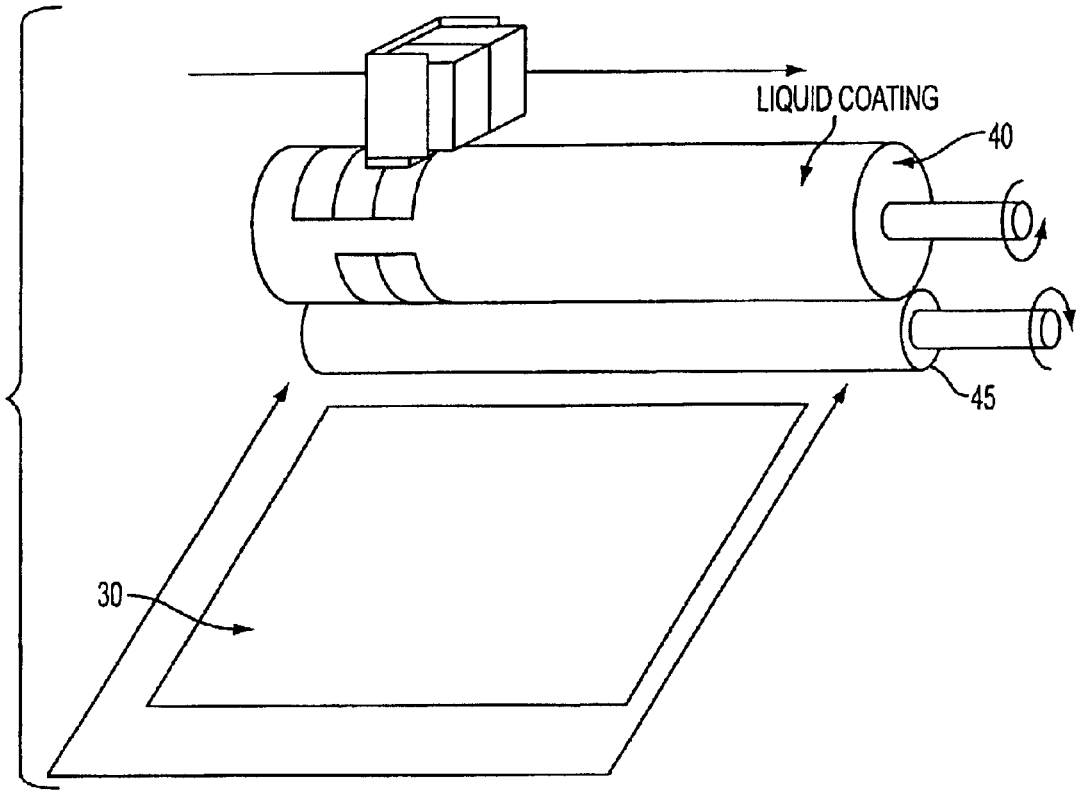
FIG. 2 is an illustration showing helical swath printing onto an ITM by a print head.

Reference will now be made in detail to the preferred embodiments of the present invention, examples of which are illustrated in the accompanying drawings, wherein like reference numerals refer to like elements throughout.

As noted above, embodiments of the present invention are directed toward a printing system using a solid coating material, capable of containing a destabilizing material, which applied ink can freely and rapidly diffuse into, or a destabilizing material that can freely and rapidly diffuse into previously applied ink. This may include networked liquid structures (gels), waxes (potentially including surfactant materials), low shear crystalline solids (graphitic type materials) or low melting polymers. The solid material may also include a flocculent that enables the destabilizing of colorant in ink, thereby improving print quality and image release to media.

According to at least one embodiment of the present invention, the coating solid is a freestanding organic based gel with lamellar crystal structure. A gel is a highly cross-linked network of relatively weak secondary bonds that act together to form a solid like structure. There is an ordering of this network to form crystal structures in the solid. Certain crystal structures have beneficial effects to the coating process such as a self limiting property that may prevent over or under coating of the material on the drum. They also may help in reducing the amount of energy necessary to coat the material and ensure uniformity of the coating. Under shear, rigid crystals of a lamellar crystal structure slide on the non-crystalline regions allowing flow of the rigid crystals. Alternative solid coating materials may also include waxes that contain destabilizing materials. Essentially, the term "solids," in regards to the present invention, is a term that may encompass many materials in many different states, except a liquid state. For example, applied gel solids may have the appearance of a liquid, but still have states characteristics of a solid, e.g., an ordered internal structure.

In accordance with the preferred embodiments of the present invention, there is provided an ink-jet printing method and apparatus applying a coating solid onto a medium, such as media (e.g., paper), an ITM, or a transfer medium, for example, and printing onto the medium, or in the case of the transfer medium, printing onto another medium or media after transfer of the coating solid from the transfer medium. Combinations of methods and apparatuses of coating and printing can be interchanged with alternate methods and apparatuses for the ultimate ink jetting process.

As defined herein, an intermediate transfer medium (ITM) can be a medium onto which either ink alone or both a coating solid and ink is applied, with another medium (e.g., paper) thereafter being applied to the ITM to transfer, respectively, the ink alone or the coating solid and ink to the other medium. FIGS. 3A–3D illustrate an example of coating solid layer 50 and ink image 55 being applied to ITM 40, and eventually transferred to media 30. Further, FIGS. 4A–4D and 5A–5D, respectively, illustrate an ITM using a coating solid roller and an ITM being a belt ITM.

A media support medium can be defined as a medium which supports another medium (e.g., paper), with the coating solid and/or ink being applied to the medium while on the media support medium. In another example, paper can be mounted on a media support medium and coating solid and ink can then be applied to the paper, with ink being applied to the medium after release from the media support medium. Similarly, FIGS. 15A–15E illustrate media support medium 100 mounted with media 30, with media 30 then being coated with the coating solid and applied with ink to form coating solid layer 50 and ink image 55, and then released from media support medium 100. Similarly, FIGS. 19A–19E illustrate media support medium 100 being used to transfer an applied image to coated portions of media 30.

Figure 16A:
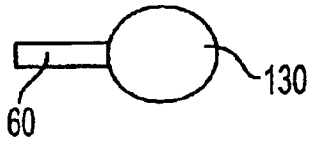
FIGS. 16A–16D are illustrations of another embodiment of the present invention with a coating solid being applied to a transfer medium, by which the coating solid is transferred to media, with ink being applied to a corresponding media portion after it is coated by the transfer medium.
Figure 16B:
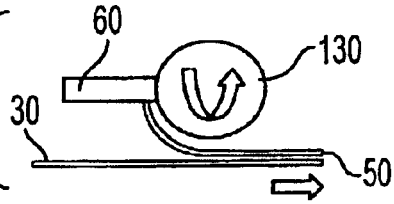
Figure 16C:
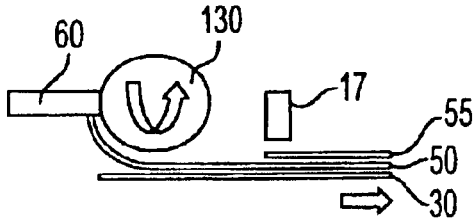

Further, a transfer medium can be defined as a medium which applies a coating solid to either an ITM, media on a media support medium, or media (e.g., paper) directly. For example, FIGS. 16A–16D illustrate coating solid being applied to transfer medium 130, which when transfers the coating solid to media 30 to form coating solid layer 50. In FIG. 16C, after transfer of the coating solid to media 30, ink is then jetted onto media 30 to form ink image 55. FIG. 17 also shows a similar use of transfer medium 130 to form a coating solid layer.

The following embodiment of the present invention, relating to FIGS. 3A–3D, includes a coating system, including applying a coating solid on an ITM, which could be a drum or belt, for example. Ink is then applied to the coated ITM, and the resultant image transferred to media, along with all or some of the applied coating solid. Although this embodiment is directed toward an inkjet printer having an ITM, the discussion of the same is similarly applicable to additional embodiments directed toward inkjet printers based on applying coating solid material to media mounted on a media support medium or applying coating solid material to a transfer medium or directly to media.

Figure 3A:
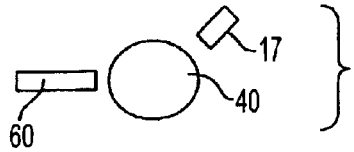
FIGS. 3A–3D are illustrations of an embodiment of the present invention with a coating solid being applied to an ITM.
Figure 3B:
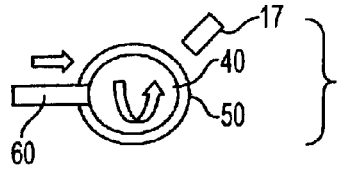

As illustrated in FIG. 3A, the coating system may include coating stick 60 and ITM 40. The coating operation includes pushing coating stick 60 into contact with rotating ITM 40, as illustrated in FIG. 3B. Coating stick 60 is brought into contact along a radial line toward the central axis of the drum. Coating solid of coating stick 60 can be transferred to ITM 40 via shear thinning, liquefication, or by abrasion or other mechanisms, resulting in a coating solid layer 50 on the drum. Since coating solid layer 50 on ITM 40 is in a solid form, and since the application of coating solid layer 50 only requires the application of a solid material to the surface of ITM 40, the drawbacks of conventional liquid coating systems can be overcome.

Figure 3C:
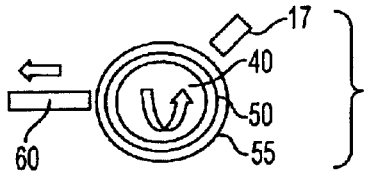
Figure 3D:
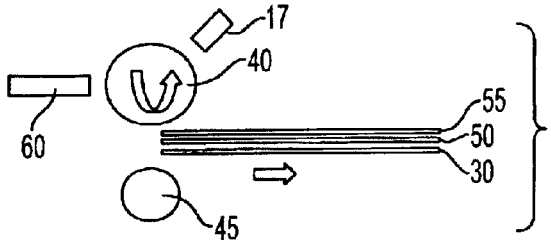
Figure 4A:
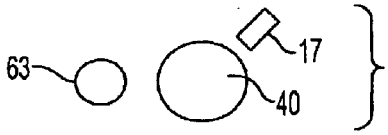
FIGS. 4A–4D are illustrations of an embodiment of the present invention, similar to the embodiment of FIGS. 3A–3D, using a coating solid roller.
Figure 4B:
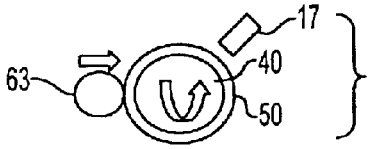
Figure 4C:
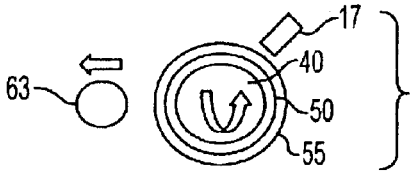
Figure 4D:
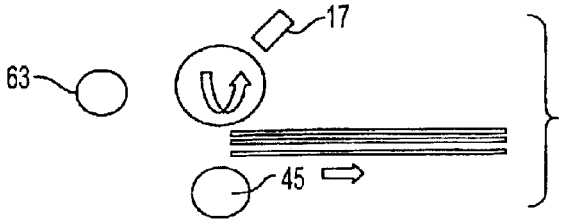
Figure 5A:
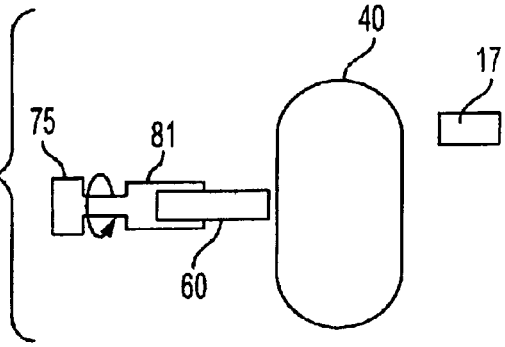
FIGS. 5A–5D are illustrations of an embodiment of the present invention, similar to the embodiment of FIGS. 3A–3D, using a belt ITM.
Figure 5B:
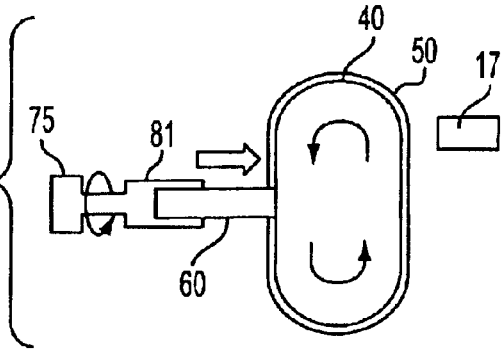
Figure 5C:
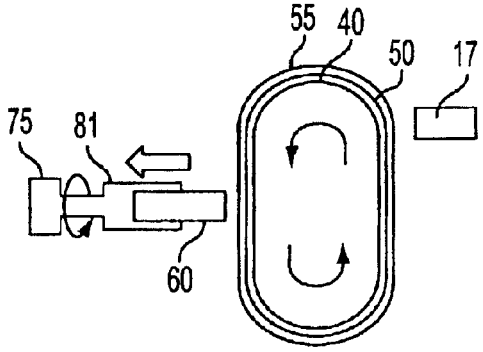
Figure 5D:
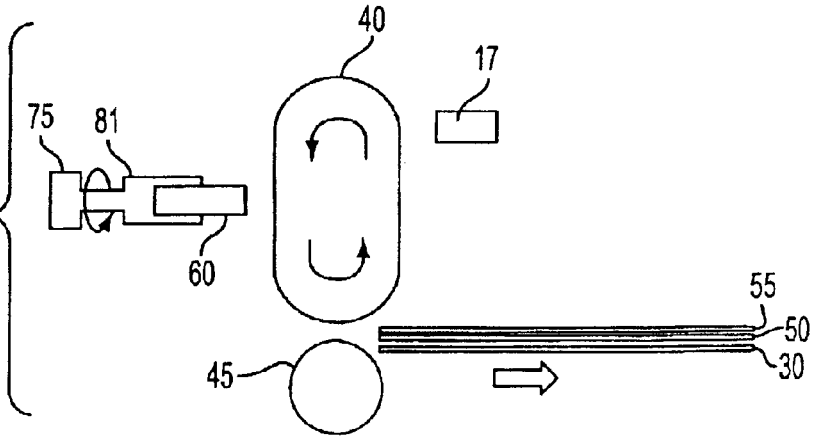

The coating system produces coating solid layer 50 on ITM 40 during one or more revolutions of ITM 40, after which coating stick 60 withdraws from contact with ITM 40, and a printing operation onto ITM 40 is performed, using print cartridge(s) 17 to generate an ink image 55, as illustrated in FIG. 3C. After completion of the printing operation, media 30 can be made to come into contact with ITM 40 through a nip generated between ITM 40 and roller 45. As media 30 advances through this nip, ink image 55 on ITM 40 is transferred to media 30, along with all or some of coating solid layer 50.

Although the coating solid is illustrated as being a coating stick, the solid coating material for embodiments of the present invention could easily be encapsulated as a coating solid roller, for example, such that contact with ITM 40 would result in a similar application of the coating solid to ITM 40. The above mentioned processes of FIGS. 3A–3D are thus equally applicable to FIGS. 4A–4D, which illustrate applying coating solid using a coating solid roller 63. In addition, FIGS. 5A–5D illustrate the above process with ITM 40 being a belt ITM, with the process also being similarly applicable.

Coating stick 60 could be designed to cover the entire width of an imaging area of ITM 40, or it could be a fraction of that width. If the width of coating stick 60 is the full width of ITM 40, then coating stick 60 could remain stationary as ITM 40 rotates against it, which will be designated as a page-wide "stationary" coater. If the width of coating stick 60 is a fraction of the width of the imaging area of ITM 40, then coating stick 60 must travel axially across ITM 40, as ITM 40 rotates, coating in a helical (spiral) pattern, for example, which will be called a "traveling" coater. Each helical pass of coating stick 60 around ITM 40 could overlap somewhat with previous passes to improve coating uniformity on the surface of ITM 40. In addition to a helical application, coating stick 60 could be axially moved in a step-wise manner, such that a number of swaths are generated across the width of ITM 40, with the number of swaths depending on the width of coating stick 60 and ITM 40.

For machine width and throughput reasons, a coating system implementing a page-wide stationary coating stick is the preferred embodiment of this type of coating system. If a traveling coating system were used, throughput issues may require that the coating operation be performed simultaneously with a helical printing process, placing heavy demands on ITM velocity control during high-torque operations. A traveling coating system may also add extra length of ITM 40, for a lead-in distance ahead of a print head, and may require additional rotation of ITM 40 for the coating system to travel the lead-in distance. A traveling coating system may also require either a large heavy coating supply item (e.g., a coating stick) to move continuously during printing, or else the coating solid material must be liquefied in a fixed reservoir and then pumped to a coating head, where it can resolidify, and then be applied to ITM 40. Page-wide stationary coating systems would appear to avoid the potential drawbacks of traveling coating systems, though embodiments of the present invention are drawn to both page-wide stationary coating systems and traveling coating systems.

It is important to control both coating thickness and coating uniformity, both within a single coating and during potential successive coatings. Multiple coatings may merely include applying coating stick 60 to an area of ITM 40 for more than one rotation of ITM 40, in a stationary coating system, or perhaps through an application of coating stick 60 to ITM 40 for multiple travels across the width of ITM 40, in a traveling coating system. For each coating, sufficient active chemical substances to accomplish the required effects for printing and transfer or release must be delivered. However, supply yields have shown to be improved if only a minimum required coating thickness is produced each coating. To balance these needs, accurate control of the coating process is preferred.

The coating solid thickness can be controlled by controlling contact pressure exerted by coating stick 60 onto ITM 40, by the rotational speed of ITM 40, by a roughness and surface energy of the surface of ITM 40, by the number of revolutions of ITM 40 is in contact with coating stick 60, and by the chemical and physical properties of the coating solid.

Figure 6:
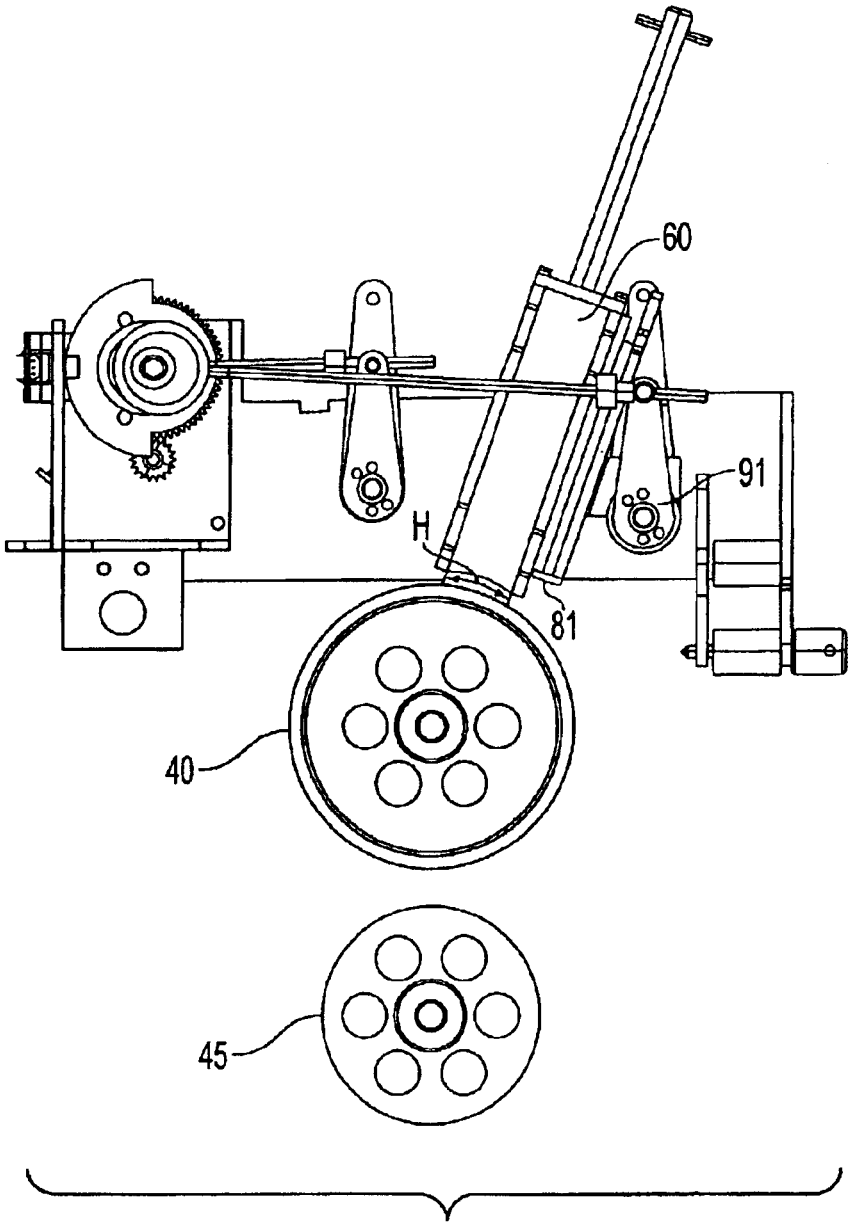
FIG. 6 is an illustration of a coating solid application mechanism, according to an embodiment of the present invention.
Figure 7:
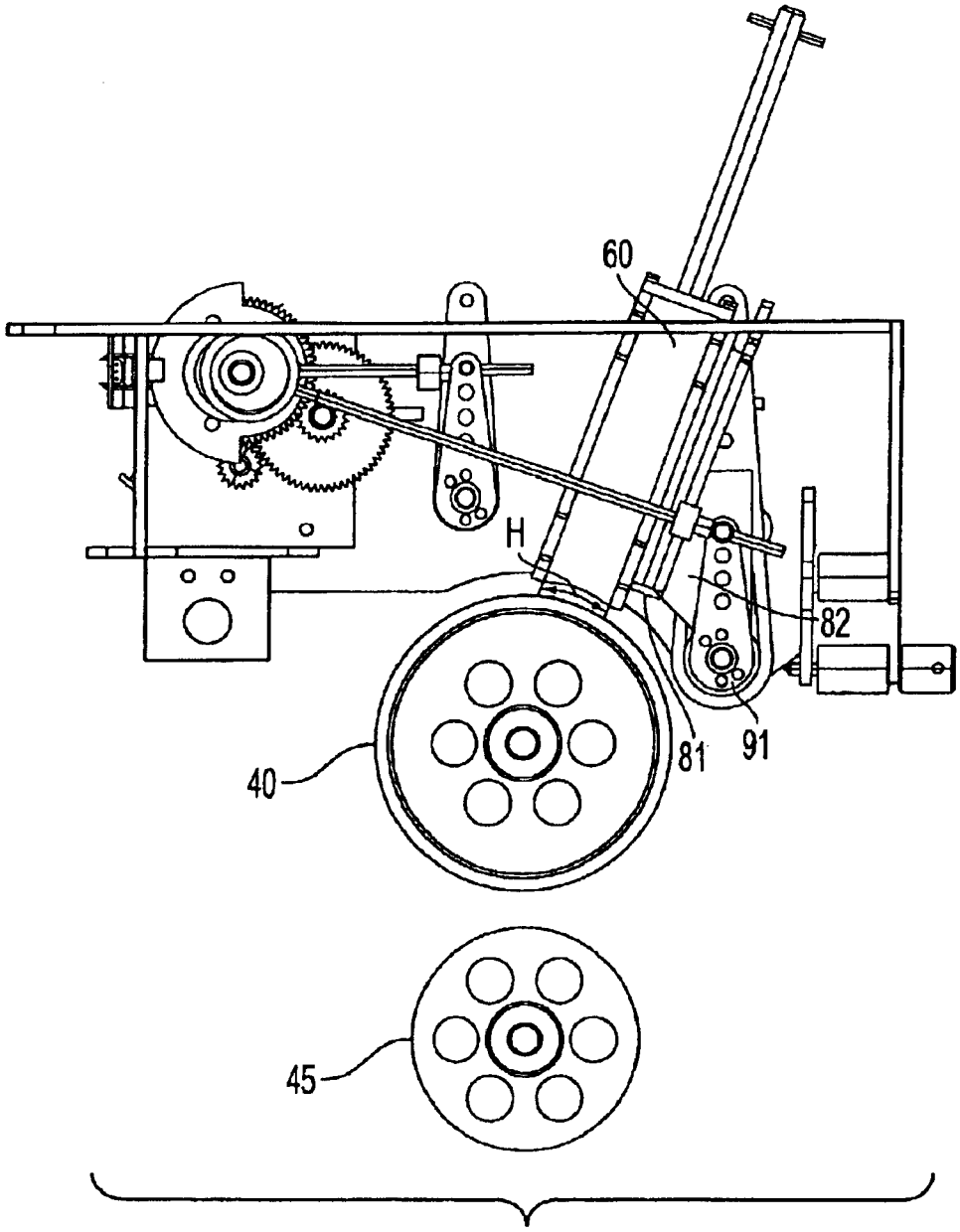
FIG. 7 is an illustration of another coating solid application mechanism, according to an embodiment of the present invention.
Figure 8:
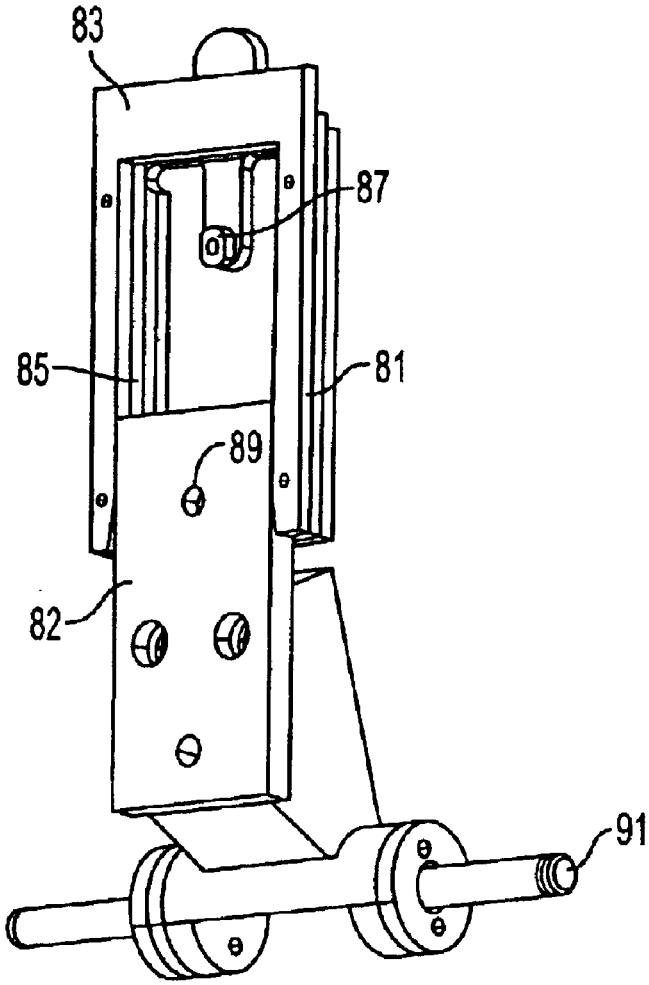
FIG. 8 is an illustration of a removable coating holder, according to an embodiment of the present invention.

An experimental 2 inch-wide solid coating system was developed as an example for a page-wide solid coating system, and is embodied in the coating systems illustrated in FIGS. 6–8.

FIG. 6 illustrates a side view of a solid coating system, including coating stick 60 and mechanisms to support and advance coating stick 60 against ITM 40, as well as to withdraw coating stick 60 from ITM 40. FIG. 6 further illustrates roller 45, which can be advanced toward ITM 40 to generate a nip between the two. The rotational speed of ITM 40, as well as roller 45, may be controlled as media is advanced through the nip. In addition, the pressure generated by the nip can similarly be controlled at least by controlling the proximity of roller 45 and the surface of ITM 40, which can be controlled by a spring, for example, applied to roller 45. Coating stick 60 of the coating system illustrated in FIG. 6 was successfully operated in a stationary coater mode to produce coatings for narrow images, and successfully operated in a traveling mode to produce wider coatings.

FIG. 7 illustrates a side view of another coating system, which improves upon the design of the coating system illustrated in FIG. 6. The primary difference between the coating system illustrated in FIG. 7 and the coating system illustrated in FIG. 6 is the location of pivot point 91, which controls the advancement of coating stick 60 to and from ITM 40. In the coating system illustrated in FIG. 7, pivot point 91 is oriented on a line of action of the friction force of the surface of ITM 40 on the working face H of coating stick 60. Essentially, by placing pivot point 91 at this location, the application friction force of coating stick 60 and the surface of ITM 40 does not change the contact pressure of coating stick 60 on the surface of ITM 40. Potential contact pressure variability and vibration problems of the coating system illustrated in FIG. 6 can thus be overcome by the relocation of pivot point 91 in the coating system illustrated in FIG. 7.

Embodiments of the present invention are also directed toward allowing coating sticks to be easily installed and removed from solid coating systems. FIG. 8 illustrates an alignment and locking system for stick holder 81. In FIG. 8, coating stick 60 is not shown in stick holder 81, for clarity, however coating stick 60 would be located along the displayed face plate 83 of stick holder 81. When installing a coating stick, stick holder 81 can easily slide up and down along grooves 85, with a flexible locking tab 87 on stick holder 81 accomplishing a proper positioning. When stick holder 81 is being installed, locking tab 87 is slid past an edge of mounting plate 82 of the coating system, allowing stick holder 81 to slide toward its correct operating position. When stick holder 81 reaches its proper operating position, a post on locking tab 87 drops into hole 89 in mounting plate 82 of the coating system. Locking tab 87 thereby locks stick holder 81 into a proper position, atop mounting plate 82 of the coating system, until removal and or replacement of stick holder 81 is necessary. As noted below, a replacement cartridge may include the replaceable coating stick mechanism along with a cleaning blade and waste bin, as illustrated in FIG. 17.

Stick holder 81 could also include a stick advance mechanism to assure that the end of coating stick 60 maintains the correct relationship with the surface of ITM 40. In an initial embodiment, this stick advance function can be performed manually via a threaded rod, or automated (as will be described below in the discussion of FIG. 17). Although the coating system example discussed herein uses only a 2 inch wide coating stick, the coating systems illustrated in FIGS. 6–8 could also be designed to use a page-wide coating stick of width greater than 2 inches, as well as a coating solid roller.

Regarding the aforementioned coating systems illustrated in FIGS. 6 and 7, with the 2 inch-wide coating stick 60, coating stick 60 was a gel. In addition, coating stick 60 was applied to ITM 40, with a urethane surface, in a stationary coater mode. Coating stick 60 was advanced into contact with ITM 40, a coating solid was applied for a period of time, and coating stick 60 was then retracted away from ITM 40. Coating stick 60 was aligned nearly along a radial line through a center of ITM 40. In addition, the following embodiments, relating at least to Table II (below) and FIGS. 12 and 13, were operated in the stationary coating mode.

In one embodiment, ITM 40 is a cast polyurethane coating applied over an aluminum drum core. A cast layer of Adiprene L42 polyurethane from Uniroyal Chemical was ground to improve the surface finish and then spray-coated with Chemglaze A074, a clear polyurethane coating from Lord Corporation. This composition is characterized below in Table I as "Urethane Drum A." In this embodiment, ITM 40 was 9.5 inches in circumference, and significantly wider than coating stick 60. An average working face height of coating stick 60 was about 17.3 mm (in an "around-the-ITM" direction). FIGS. 6 and 7 illustrate examples of working face heights, designated by the "H" distance on coating stick 60. In addition, an effective spring force of 1.02 lbf was applied to coating stick 60, including a moment of coating stick 60 and stick holder 81. This resulted in an average contact pressure between coating stick 60 and the surface of ITM 40 being about 1.7 psi. At an ITM surface speed of 53.3 ips, a coating duration of 1.95 revolutions resulted in coatings of 1.09–1.10 microns average thickness, while a 1.2-revolution coating resulted in a 0.95 micron average thickness. A variety of other coating solid materials were also tested with the arrangements illustrated in FIGS. 6–8.

The coating solid layers produced by solid coating systems of FIGS. 6–8 were reviewed for average thickness, with the effect of various parameters on coating thickness also being measured. Further, alternative materials were used in surface constructions of ITM 40, including urethane, Teflon, and aluminum. These ITMs have been characterized in Table I (below) for surface roughness, surface energy, and hardness. As noted above, the surface of "Urethane Drum A" was made of Adiprene L42 spray-coated with A074, while the surface of "Urethane Drum B" was made of an uncoated Adiprene L42.

TABLE I

| | Drum properties | | | |
|---|---|---|---|---|
| Drum Label | Roughness (Ra, microns) | Roughness (Rz, microns) | Surface Energy (dynes/cm^2) | Hardness (Shore A) |
| Urethane Drum A | 0.08 | 0.71 | 45 | 70 |
| Urethane Drum B | 1.0 | 6.33 | ~26–29 | 60 |
| Teflon Drum | 0.4 | 2.45 | 17 | N/A |
| Aluminum Drum | 0.57 | 3.03 | 29.5 | N/A |

Figure 9:
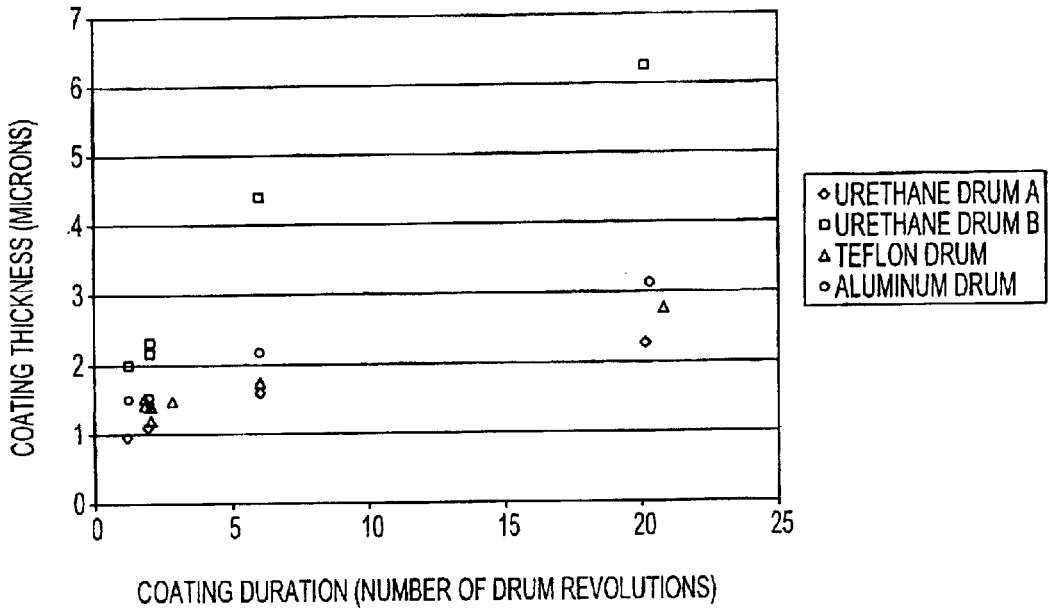
FIG. 9 is a graph on the effect of coating duration compared to coating solid layer thickness, according to an embodiment of the present invention.
Figure 10:
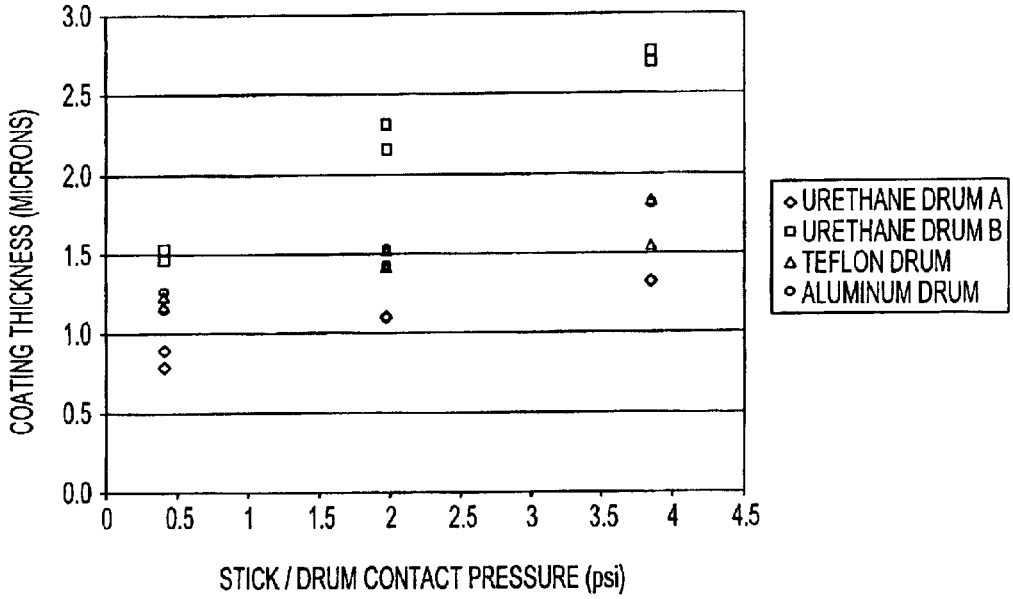
FIG. 10 is a graph on the effect of contact pressure compared to coating solid layer thickness, according to an embodiment of the present invention.

FIG. 9 illustrates the correspondence between coating thickness on the length of time coating stick 60 is in contact with the surface of ITM 40, ranging from 1 to 20 revolutions of ITM 40, with the surface speed of ITM 40 being 53.3 ips with a contact pressure of 2 psi. The coating thicknesses are somewhat self-limiting, in that later ITM revolutions deposit much less coating material than initial ITM revolutions. FIG. 10 illustrates the correspondence between the contact pressure between coating stick 60 and the surface of ITM 40 and coating thickness, with a 53.3 ips ITM surface speed and two ITM rotations. As contact pressure increases, coating thickness increases, although not very quickly. In both FIGS. 9 and 10, the rougher of the two urethane ITMs (Urethane Drum B) generated substantially thicker coatings than the other ITM, under similar coating conditions. All contact pressures set forth in FIG. 10 are only approximate contact pressures, as variations in spring constants might have resulted in a 20% variation in contact pressures.

Figure 11:
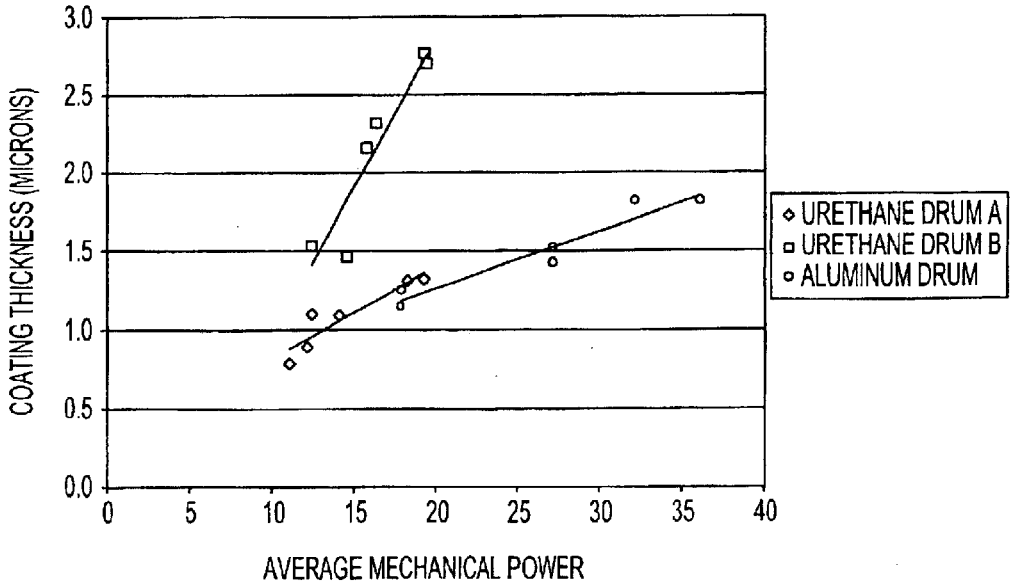
FIG. 11 is a graph on the effect of average mechanical power required compared to coating solid layer thickness, according to an embodiment of the present invention.

The power requirements to make these coating solids using these two different urethane ITMs, are also plotted in FIG. 11. Each data set in FIG. 11 represents a range of contact pressures from 0.4–3.9 psi, for coating sticks with a working face height of about 17.3 mm and a width of 2 inches; power was recorded in Watts. Straight lines in the plot are least-squares fits to each data set. For a coating thickness around 1 micron at a 53.3 ips surface speed of ITM 40, for 2 drum revolutions, Urethane Drum A has the lowest estimated power requirement. Urethane drum B might have an even lower power requirement at a lower contact pressure than tested, but it may not generate uniform coatings at such light pressures.

The high power requirements illustrated in FIG. 11, typically, would not be desirable in a desktop inkjet printer. Therefore, further design improvements were implemented. As noted above, by changing the material, surface energy, and roughness of the surface of ITM 40, the power needed to generate a certain solid coating thickness in a fixed time or number of revolutions can be optimized. For example, the use of a rougher urethane ITM might allow for the generation of thin coatings at low contact pressure and low power. Unfortunately, this might limit the use of materials or finishes beneficial for other reasons. Through experimentation, it was determined that in an embodiment of the present invention, preferably, the roughness of the surface or ITM 40 should be between 0.05 microns and 1.5 microns Ra. Another way to reduce power requirements is to reduce the process speed for the coating operation, which would provide a large reduction in power requirements, though, it would also reduce the throughput of the printer.

Figure 12:
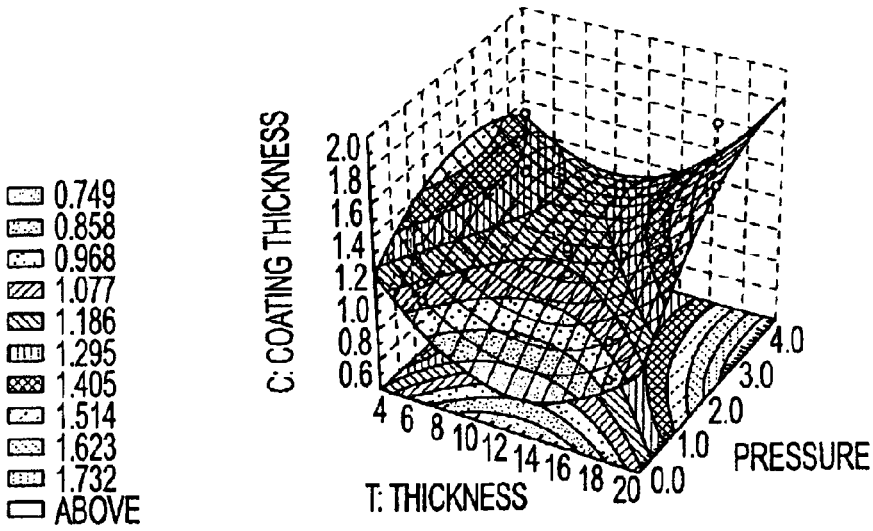
FIG. 12 is a three-dimensional graph comparing coating solid layer thickness, coating stick working face height, and coating stick applied pressure, according to an embodiment of the present invention.
Figure 13:
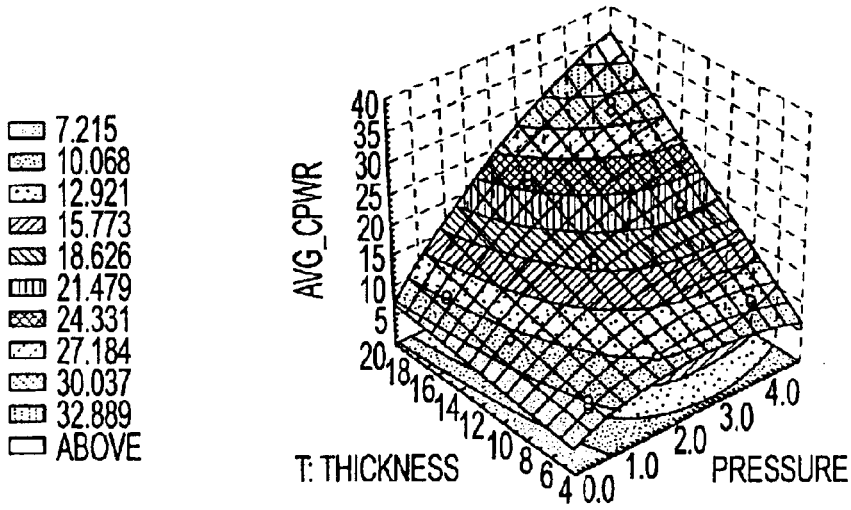
FIG. 13 is a three-dimensional graph comparing coating solid layer thickness, average power requirements, and coating stick applied pressure, according to an embodiment of the present invention.

To reduce power requirements while still maintaining ITM choice and full-speed coatings, it was determined that different coating sticks of different working face heights around ITM 40 could be used. By reducing the working face height, drum drag and torque are thereby reduced, while similar coating solid thicknesses on ITM 40 can still be achieved. Table II (below) details experimental data collected at an ITM surface speed of 53.3 ips. This experimental data is also plotted in FIGS. 12 and 13. In FIGS. 12 and 13, coating solid layer thicknesses are in microns, coating stick working face heights ("Stick Thickness") are in millimeters, contact pressures are in pounds per square inch, and mechanical power requirements are in Watts.

FIG. 12 illustrates a plot of resulting coating solid thickness versus coating stick working face height ("T Thickness") and contact pressure. As illustrated in FIG. 12, shorter coating sticks, i.e., coating sticks with small working face heights, can produce coating solid layers of similar thicknesses to those produced by coating sticks with greater working face heights.

FIG. 13 illustrates a plot of the power requirements, according to the coating parameters used FIG. 12. The plot illustrated in FIG. 13 indicates that lighter contact pressures and shorter coating sticks require less power to maintain ITM speed while performing coating operations. Based on these results, preferably the height of the working face of coating stick 60 should be less than 12 mm, and optimally around 6 mm, to achieve low power consumption with a reasonable coating solid layer thickness. In addition, through experimentation, it was determined that an optimal thickness of the coating solid layer is between 0.1 and 10 microns, and preferably between 0.5 and 2 microns. Similarly, it was determined that the contact pressure of coating stick 60 and the surface of ITM 40 should be less than 5 psi, and preferably less than 2 psi.

Table II illustrates coating solid thickness and power required for different coating stick working face heights ("Stick Thickness"). These coatings were generated on "Urethane Drum A"; the power requirements were for a 2 inch coater width.

TABLE II

| Run # | Stick Thickness mm | Contact Pressure psi | Drum Revolutions | Average Total Power W | Average Coater Power W | Peak Coater Power W | Coating Thickness microns |
|---|---|---|---|---|---|---|---|
| 1 | 17.3 | 3.9 | 1.4 | 35.2 | 29.7 | 46.3 | 1.33 |
| 2 | 17.3 | 2.2 | 2.1 | 27.8 | 22.3 | 36.6 | 1.55 |
| 3 | 17.3 | 3.9 | 3.2 | 33.4 | 28.0 | 49.8 | 1.72 |
| 4 | 17.3 | 0.5 | 1.4 | 14.9 | 9.2 | 13.9 | 0.79 |
| 5 | 17.3 | 0.5 | 3.0 | 15.3 | 9.9 | 15.0 | 1.05 |
| 6 | 17.3 | 2.2 | 2.1 | 29.0 | 23.3 | 37.0 | 1.27 |
| 7 | 11.5 | 3.9 | 2.2 | 23.8 | 18.9 | 33.5 | 1.18 |
| 8 | 11.5 | 2.1 | 2.1 | 20.6 | 15.4 | 26.3 | 1.08 |
| 9 | 11.5 | 2.1 | 1.4 | 21.2 | 15.7 | 28.0 | 0.95 |
| 10 | 11.5 | 0.5 | 2.1 | 14.8 | 9.9 | 16.4 | 0.91 |
| 11 | 11.5 | 2.1 | 3.2 | 21.7 | 16.4 | 31.2 | 1.27 |
| 12 | 11.5 | 3.9 | 2.1 | 24.3 | 19.5 | 33.6 | 1.13 |
| 13 | 11.5 | 2.1 | 2.1 | 22.1 | 16.7 | 28.5 | 1.12 |
| 14 | 5.5 | 0.6 | 3.2 | 12.2 | 6.0 | 11.5 | 1.24 |
| 15 | 5.5 | 0.6 | 1.4 | 12.1 | 7.1 | 14.5 | 0.90 |
| 16 | 5.5 | 3.8 | 3.1 | 15.4 | 10.5 | 19.5 | 1.48 |
| 17 | 5.5 | 3.8 | 1.3 | 15.6 | 10.6 | 19.4 | 1.09 |
| 18 | 5.5 | 0.6 | 1.3 | 12.7 | 7.6 | 14.2 | 1.02 |
| 19 | 5.5 | 3.8 | 1.3 | 16.4 | 11.1 | 20.4 | 1.10 |
| 20 | 5.5 | 2.0 | 2.0 | 14.3 | 9.2 | 19.0 | 1.33 |

Figure 14A:
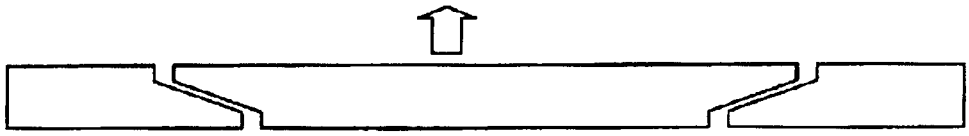
FIGS. 14A–14C are illustrations of potential page wide coating solid applicators, according to embodiments of the present invention.
Figure 14B:
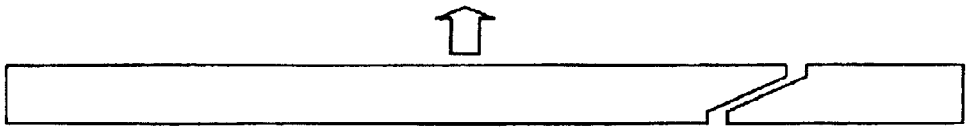
Figure 14C:
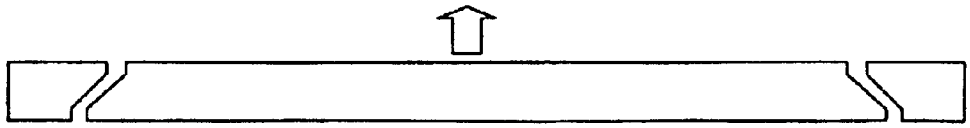

Additional embodiments are directed toward an inkjet ITM printer that operates in a landscape mode, with a long edge of media 30 aligned along a length of ITM 40. To operate with letter-size and legal-size media, different image areas may be jetted onto ITM 40. That is, the legal-size image area may be a superset of the letter-size image area. Thus, page-wide coating sticks or rollers should be segmented to enable variable-size coatings of coating solid on ITM 40. To accomplish this segmentation, there may be several "sub-sticks" or "sub-rollers," which contact ITM 40 along different axial areas across the width of ITM 40. For example, a single sub-stick could contact the surface of ITM 40 to generate a letter-size coating of coating solid, while two or more sub-sticks could be made to come into contact with ITM 40 to generate a legal-size coating of coating solid. Ideally, the sub-sticks or sub-rollers should be actuated separately to accomplish this task. To avoid coating defects at the interface between sub-sticks, for example, the sub-sticks may include overlapping joints, as shown FIG. 14A. The relative positions of the sub-sticks could be changed depending on whether a letter-size image is centered over the legal-size image or not. FIGS. 14B and 14C illustrate configurations that can support center-fed and edge-fed paper feed systems. In FIGS. 14A–14C, the direction of the overlapping zones between segments should be oriented to minimize coating defects; this might require reversing the indicated direction of ITM rotation. In FIGS. 14A–14C, the illustrated arrow signifies ITM rotation or media travel direction. Coating stick segmentation could also be extended to the use of many smaller stick segments, enabling the generation of coatings of coating solid only as big as the image to be prepared, e.g., when media of different widths are used. This would allow greater supply life, although issues with segment actuation, differential wear, and drum cleaning might require design improvements.

Thus, if the ink transfer and release process is compatible, it is preferable to coat only particular regions of ITM 40, for a variety of media widths, since any excess coating probably needs to be cleaned off ITM 40 and disposed of. Coating solid can be transferred to a limited width of ITM 40, corresponding to the width of the narrow media.

Alternatively, if coating solid is applied to a greater width then a media width, coating solid that remains on ITM 40, along the portion of ITM 40 that did not contact the media, can be thereafter removed by a cleaning blade and transferred to a waste bin. An example of such cleaner blade/waste bin mechanism is disclosed in FIG. 17, in an embodiment directed to applying coating solid to a transfer roller.

However, in normal operation with full-width media, such a cleaner blade operation would result in a waste of coating solid, thereby reducing the potential coating yield. Therefore, it is desirable to operate the system without using a cleaner blade. Unfortunately, coating narrow media without using a cleaning blade can lead to differential wear of the coating stick. The portion of the coating stick aligned with the narrow media will progressively wear as additional media are coated, resulting in this differential wear, and resulting in coating defects.

An alternate solution to this problem uses a belt ITM, rather than a drum, together with a mechanism for rotating coating stick 60. FIGS. 5A–5D illustrate a belt ITM, with rotation mechanism 75 having the capabilities of rotating stick holder 81. Coating stick 60 can be rotated from being perpendicular to the direction of media travel, to having an oblique orientation. This orientation can be selected for a given media size so that coating stick 60 extends from one edge of the media to the other, without extending past the edges of the selected media. This produces a partial-width coating on the belt, aligned with the position of the narrow media. In this way, the whole width of coating stick 60 will be used uniformly. As a result, when coating stick 60 is returned to the perpendicular position and used to coat full-width media, there won't be a differential wear on coating stick 60, creating coating defects.

In an additional embodiment, a doctor blade may be included in the coating system, to assure coating uniformity or to modify the coating thickness. A doctor blade could be added right at the edge of coating stick 60 or it could be placed farther around ITM 40. The doctor blade serves to level the applied coating solid, both setting the thickness and smoothing the coating solid to improve coating uniformity. Some coating defects that could be improved by the addition of a doctor blade include both across-the-ITM coating defects, which might be caused by improper alignment of coating stick 60, or the aforementioned differential wear of coating stick 60. Around-the-ITM coating defects include marks made by coating sticks when they land on an ITM, or when they are lifted away from an ITM. Both types of coating defects could be reduced or eliminated by the inclusion of a doctor blade. The doctor blade would also prevent any coating debris from contacting inkjet print heads, which depending on the coating chemistry, could injure or destroy the print heads.

An additional embodiment of the present invention includes a capping station to seal coating stick 60 from the external environment. The sealing of coating stick 60 from the environment is desirable since a coating stick's properties may be modified by exposure to different humidities or extreme temperatures. The sealing of coating stick 60 can be accomplished with a separate capping station that would seal the open ends of coating stick 60 and stick holder 81. Alternately, coating stick 60 could be capped by pressing it against ITM 40 when the printer is not being operated. Flexible seals around the perimeter of the working face of coating stick 60 could complete a seal. This would avoid the need for a separate capping station, and avoid the space and mechanisms needed to move coating stick 60 to such a station.

In a further embodiment of the present invention, an alternate mechanism for moving coating stick 60 into contact with ITM 40 could be used. The aforementioned mechanisms, as shown in FIGS. 6 and 7, pivot the ends of the coating stick into contact with ITM 40. This design was primarily used for simplicity and ease of integration into a product. However, coating stick 60 could also be pushed straight onto ITM 40, via a linear motion system or a four-bar linkage. An example of such a straight pushing mechanism is illustrated in the embodiment of the present invention related to FIG. 17, where coating stick 60 is pushed straight onto transfer roller 130. Such a system might be desirable to change the way coating stick 60 wears immediately upon contacting ITM 40, or it might be useful to decrease the time needed to engage or disengage coating stick 60 on ITM 40.

In yet another embodiment of the present invention, a transfer medium, e.g., a roller or belt, could be arranged between coating stick 60 and ITM 40. Coating stick 60 would first apply coating solid to the transfer medium, which would then in turn apply coating solid to ITM 40. The use of a transfer medium could provide several benefits. First, it allows for different surface speeds of the stick coating process on the transfer medium and the transfer process to ITM 40. In this manner, the coating process to the transfer medium could be maintained at a constant speed even while an ITM 40 was operated at different speeds (e.g. to support different printing resolutions). Second, the use of a transfer medium permits a film-split between the transfer medium and ITM 40, leaving some coating solid on the transfer medium after a transfer of coating solid to ITM 40. FIG. 17 illustrates an example of the use of a transfer medium, though in FIG. 17 transfer medium 130 applies the coating solid directly to media 30, but could easily be modified to apply the coating solid from the transfer medium to ITM 40 or a media support medium, as well.

If it were necessary to use a certain set of coating stick coating parameters that created an undesirably thick coating solid layer, then a film-split between the transfer medium and ITM 40 could reduce the thickness of the eventual coating on ITM 40 to a desired thickness. For some applications, the transfer medium may be required to have an equal diameter (roller) or length (belt) as ITM 40 to transfer a complete coating of the coating solid in a single rotation. For other applications, the diameter or length of the transfer medium could be reduced, thereby accepting a coating solid at one angular position while continuously transferring it to ITM 40 at another angular position. Depending upon the relative sizes of ITM 40, the film-split ratio desired, and the application of coating solid, the transfer medium might rotate or advance the same speed, faster, or slower than ITM 40. The coating application of coating solid to the transfer medium may also occur simultaneously with the transfer of the coating solid to ITM 40, or it might precede it in time. The below discussed embodiments relating to FIG. 16A–16D and FIG. 17 set forth examples of how a transfer medium could be used, i.e., applying coating solid to transfer medium 130 which directly transfers the same to media 30.

It is also desirable to have a coating system that can operate at a variety of ITM speeds to match a range of inkjet printing process speeds. For this to happen, either the coating parameters (thickness and uniformity) must be insensitive to ITM speed over the range of interest, or else another coating setting must be changed to restore the desired coating parameters at a given speed. This can most easily be accomplished by changing contact pressures as speed changes.

Another possible embodiment of the present invention includes changing the contact angle of coating stick 60 on ITM 40. The aforementioned embodiments discussed pushing the coating stick onto ITM 40 along a radial line of ITM 40, essentially with a zero angle along the radial line of ITM 40. However, if this angle is changed, either steeper or shallower, vibration modes of coating stick 60 against ITM 40 will change. This can be important during either a static portion of the coating process, while coating stick 60 is sliding along the surface of ITM 40, or a dynamic portion of the coating process, while coating stick 60 and ITM 40 are engaging or disengaging. In addition to minimizing and controlling vibration, the angling of coating stick 60 can also affect and reduce chatter. Chatter can be considered an oscillatory or repetitive bouncing, of a coating stick, on and off of a drum or belt, which results in an uneven or irregular coating application.

Additional embodiments of the present invention could include the coating process for an ITM inkjet printer including the addition of heat from stick holder 81 or the surface of ITM 40.

An additional embodiment of this invention, as illustrated in FIGS. 15A–15E, is directed toward generating coating solid layer 50 onto media 30, when media 30 is wrapped around media support medium 100. An image would then be inkjetted directly onto media 30, using print cartridge(s) 17, either while media 30 is still mounted on media support medium 100 or after release from the same. As noted above, the differing methodologies and apparatuses used to apply coating solid material to ITM 40 is similarly applicable to media support medium 100, transfer mediums 130, and embodiments directed to applying solid coating material directly to media 30, not on a media support medium. Similarly, the coating process of FIGS. 6 and 7 have also experimentally been used to put a coating solid directly onto media 30 mounted on media support medium 100, which also could be a drum or belt, for example. In a practiced example, a gel with the laboratory code SSR010324RC, stick #2 (2" wide), was used to make a 4.2"-wide coating solid layer on a sheet of Fox River Bond paper media. The coating solid application was made in the aforementioned traveling coater mode, but it could also have been made in a page-wide coating mode with a wider gel coater.

Figure 15A:
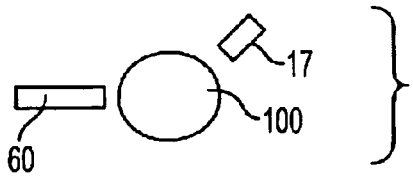
FIGS. 15A–15E are illustrations of a further embodiment of the present invention with a coating solid and ink being applied to media while mounted on a media support medium.
Figure 15B:
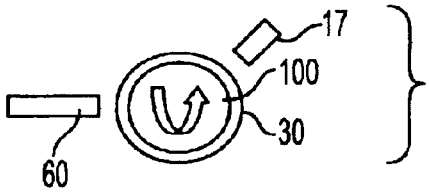
Figure 15C:
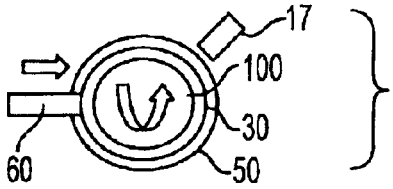
Figure 15D:
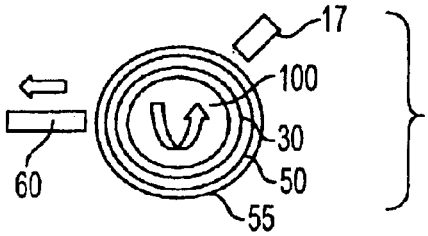
Figure 15E:
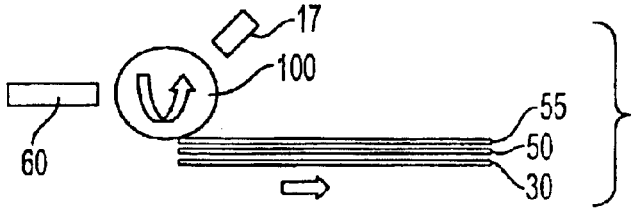

As illustrated in FIGS. 15A–15E, media 30 is mounted on media support medium 100 (FIG. 15B), coating stick 60 is applied against media 30 to generate coating solid layer 50 (FIG. 15C), ink is inkjetted to media 30 using ink cartridge 17 to generate ink image 55 (FIG. 15D), and media 30 is thereafter released (FIG. 15E). The ink printing operation does not necessarily have to be performed while media 30 is mounted on media support medium 100.

An advantage of this embodiment is that it was conventionally necessary, in some high-end graphics implementations, to use pre-coated media in inkjet printers that would then print onto the pre-coated media either using a media support medium or by printing onto the media directly. However, according to embodiments of the present invention, media can be coated within a printer, thereby negating the need of using specialty pre-coated media, which can be expensive.

Figure 16D:
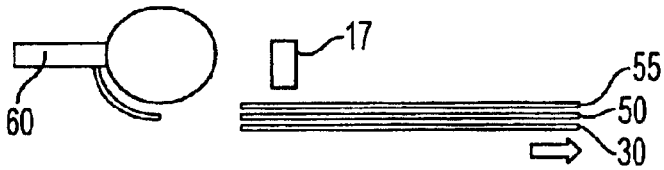
Figure 17:
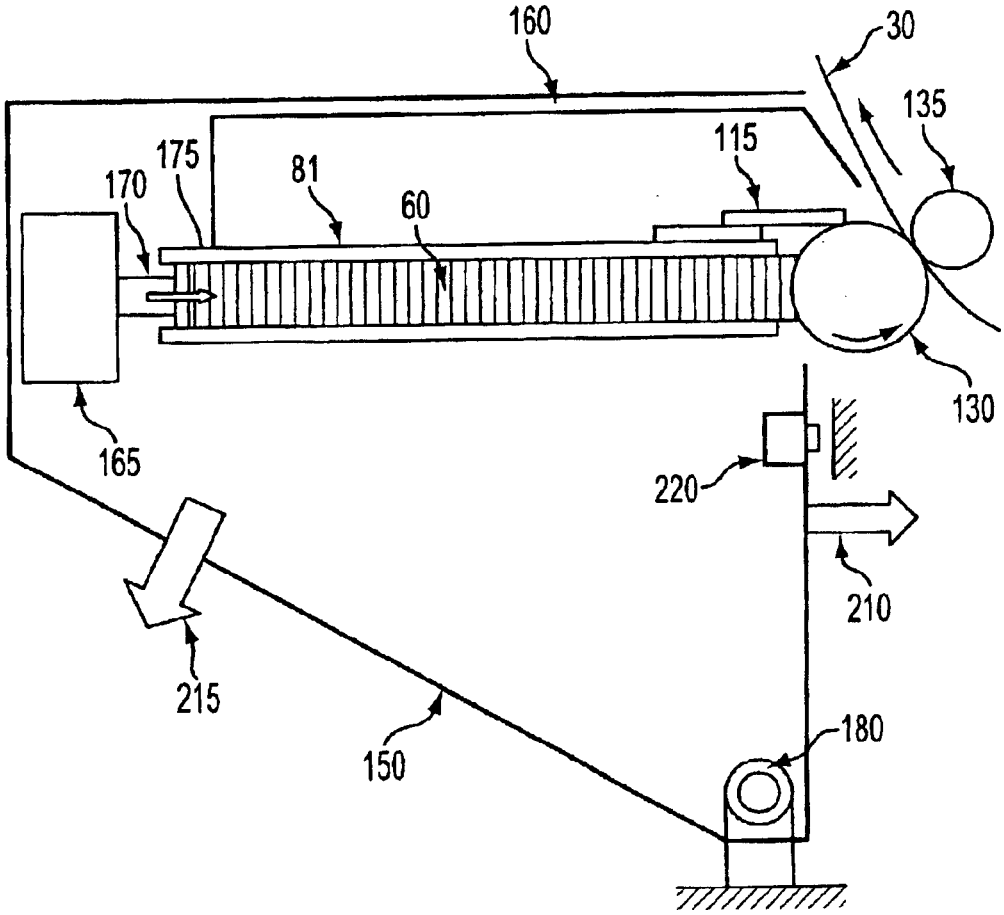
FIG. 17 is an illustration of a coating solid application system with a transfer medium, according to an embodiment of the present invention.

In a further embodiment of the present invention, and as briefly mentioned previously, coating stick 60 can be applied first to transfer medium 130, e.g., a roller or belt, and thereafter transferred directly to media 30, as illustrated in FIGS. 16A–16D. An image would then be inkjetted directly onto the coated media using ink cartridge(s) 17. As illustrated in FIGS. 16A–16D, coating stick 60 is applied against transfer medium 130 (FIG. 16A) to generate coating solid layer 50, media 30 is applied against transfer medium 130 at a nip with roller 135 (FIG. 16B), printing is commenced using ink cartridge(s) 17 (FIG. 16C), and the printing upon media 30 is then completed (FIG. 16D).

Although the following discussion of FIG. 17 is primarily directed toward mechanisms for applying coating solid to transfer medium 130, the discussion of the same is equally applicable to above application of coating solid to ITM 40, media 30 mounted on media support medium 100, or directly onto media 30.

As illustrated in FIG. 17, an embodiment of the present invention includes coating stick 60, extending the full width of the media 30 (normal to the plane in the illustration), being held in stick holder 81 and in contact with transfer medium 130. Media 30 is pressed against transfer medium 130 by spring-loaded backup roller 135. Both transfer medium 130 and backup roller 135, in this embodiment, extend at least the full width of media 30. As transfer medium 130 rotates, a controlled amount of coating solid is transferred from coating stick 60 to transfer medium 130, which in turn transfers at least a portion of the coating solid to media 30. Coating solid remaining on transfer medium 130 after the application of coating solid to media 30, either due to an incomplete transfer of coating solid or an application of only a portion of coating solid to transfer medium 130 for applications to narrow media, can then be removed by cleaner blade 115 and deposited in a waste bin 160. Coating stick 60, stick holder 81, cleaner blade 115, and waste bin 160 could be replaced periodically by the customer as a replaceable cartridge.

Similarly, in additional embodiments, the replaceable cartridge could include multiple coating sticks and/or holders, at least as discussed above. Alternatively, each element could be replaced individually. Waste bin 160 can be sized to hold all the waste material, as well as media dust and other contaminants that may accumulate during the useful life of each coating stick. In addition, a doctor blade (not shown) could be placed in contact with transfer medium 130 between the contact point of coating stick 60 and transfer medium 130 and the nip between transfer medium 130 and backup roller 135 to smooth out the coating solid before transfer to media 30. The amount of coating solid transferred to media 30 is controlled primarily by coating stick 60 contact pressure, transfer medium 130 surface roughness, transfer medium 130 surface energy, and coating stick 60 properties.

The removable cartridge could be mounted in housing 150, which can rotate about pivot 180. Spring 210 would exert a force on housing 150, thereby causing housing 150 to rotate about pivot 180, causing coating stick 60 to make contact with the surface of transfer medium 130. Spring 210 can thus control at least the initial contact pressure between coating stick 60 and transfer medium 130. As coating solid is transferred from coating stick 60 to transfer medium 130, housing 150 is further caused to rotate under the action of the spring, moving the replaceable cartridge closer to transfer medium 130. To control the proximity of coating stick 60 to the surface of transfer medium 130, proximity sensor 220 has been mounted on housing 150 to detect the distance between coating stick 60 (or the replaceable cartridge containing coating stick 60) and transfer medium 130. Based on the detected proximity, a control unit (e.g., processor 20 illustrated in FIG. 1) can control stepper motor 165 to engage lead screw 170 and pusher plate 175. This engagement advances coating stick 60 a small amount, causing housing 150 to further rotate to reestablish a proper spatial relationships of the various components. Proximity sensor 220 can then provide feedback to the control unit to disengage stepper motor 165. The control unit may also detect an amount of coating solid remaining based on the advancement of lead screw 170, for example. A separate mechanism (not shown), acting in the direction of arrow 215, also can disengage housing 150 and cap the end of coating stick 60 during idle periods, in order to minimize evaporation and contamination of the coating solid.

In an additional embodiment of the present invention, a coating solid is applied directly onto media, i.e., without requiring an ITM or media support medium, as illustrated in FIGS. 18A–18E. After the application of the coating solid an image would then be inkjetted directly onto the media, as illustrated in FIGS. 18A–18E and 19A–19E.

Figure 18A:
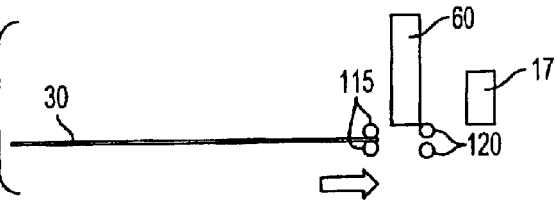
FIGS. 18A–18E are illustrations of yet another embodiment of the present invention with a coating solid being applied directly to media.
Figure 18B:
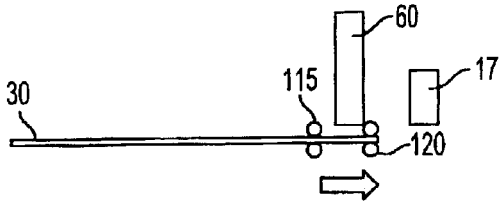
Figure 18C:
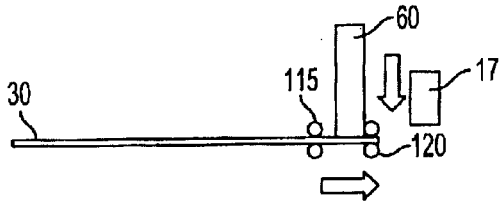
Figure 18D:
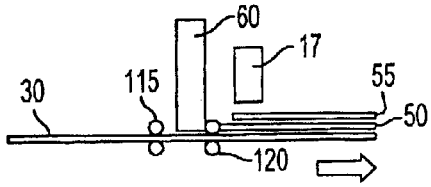
Figure 18E:
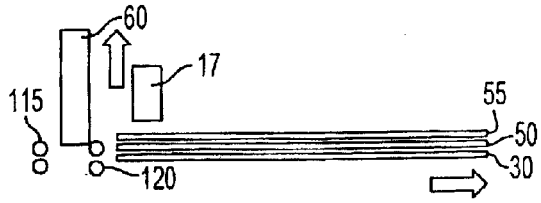
Figure 19A:
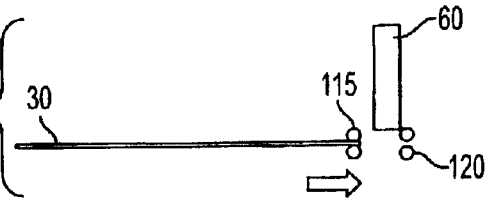
FIGS. 19A–19E are illustrations of an embodiment of the present invention, similar to the embodiment of FIGS. 18A–18E, with ink being applied to the media using a media support medium.
Figure 19B:
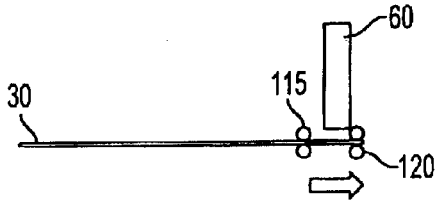
Figure 19C:
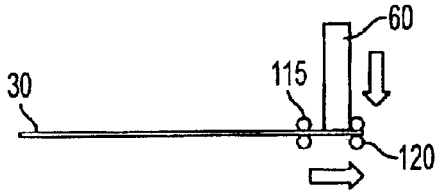
Figure 19D:
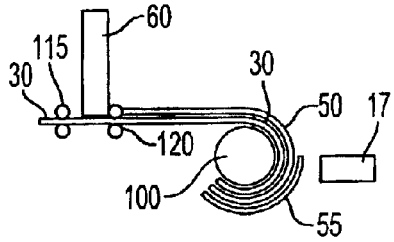
Figure 19E:
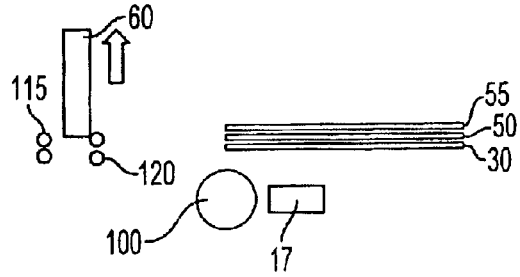

As illustrated in FIGS. 18A–18E, applying the coating solid directly to media 30 may require an independent mechanism to pull media 30 past coating stick 60, in such a manner as to remove a controlled amount of coating solid from coating stick 60. FIGS. 18A–18D show a media handling system having two sets of feed rollers 115 and 120 to control the advancement of media 30. Essentially, what is required is a mechanism, in this case feed rollers 115 and 120, to generate some opposing force or surface tension such that, when coating stick 60 contacts the surface of media 30, a controlled amount of coating solid can be applied. Feed rollers 115 are used to advance media 30 past a coating area, i.e., the area where coating stick 60 would contact media 30 (FIG. 18A), until media 30 can be grabbed by feed rollers 120 (FIG. 18B). After media 30 is captured by feed rollers 120, coating stick 60 is caused to come into contact with media 30, thereby beginning the coating process to generate coating solid layer 50 (FIG. 18C). Feed rollers 120 thereafter pull media 30 past coating stick 60 until media 60 is sufficiently coated (FIG. 18D), at which time coating solid is caused to disengage and moves away from the surface of media 30 (FIG. 18E).

Since coating cannot begin until media 30 is controlled by feed rollers 30, there may be a small region at least at the leading portion of media 30 which cannot be coated. To minimize this uncoated leading portion, feed rollers 115 and 120 should be placed close to each other, and feed rollers 120 should be placed as soon after coating stick 60 as possible. To prevent paper skew caused by drag forces on media 30 from the coating stick 60, feed rollers 115 and 120 should also be page-wide.

After the coating solid is applied to media 30 a jetting of ink can be performed by ink cartridge(s) 17 either while the coating process is commencing or after the same. FIGS. 18A–18E illustrate print cartridge(s) 17 being directly after the coating area and above media 30. However, alternative printing processes could be instituted. For example, FIGS.

19A–19E illustrate a similar coating solid application with the printing operation being performed while media 30 is mounted on media support medium 100.

Above embodiments have shown coating solid applicators in a "stick" or "roller" supply configuration. The coating solid applicator can be moved into engagement with a medium to be coated (e.g., an ITM, media on a media support medium, transfer medium, or media directly). After moving into engagement, the coating solid applicator may then be held stationary against the medium (for page-wide coaters), or travel at a velocity perpendicular to the medium surface motion (for traveling coaters). However, it is conceivable that additional relative motion between the coating solid applicator and the medium could benefit the coating process. For example, forcing the coating solid applicator to vibrate in a controlled fashion (either during page-wide or traveling mode) could result in improved area coverage and/or improved coating uniformity.

Thus, embodiments of the present invention are directed toward applying coating solids for use in printing processes. Contrary to conventional systems, coatings are made using coating solid materials rather than liquid coating materials, providing a number of advantages. The teaching of these embodiments could be applied to any solid material which forms a coating solid, whether by shear thinning and liquefication or by abrasion or other mechanisms.

In addition, although only a limited number of solid materials have been disclosed herein, the present invention is not limited thereto. Thus, a coating solid could encompass any non-liquid material performing destabilization of a colorant in an ink. Further, although embodiments of the present invention may have been directed toward inkjet printers, the present invention is not limited thereto.

Therefore, although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An ink-jet printer, comprising:

an ink-jet print head to jet ink;

a coating solid to interact with ink to destabilize colorant in the ink; said coating solid being a gel with a lamellar crystal stricture, and a coating holder to support the coating solid, wherein the coating holder transfers a portion of the coating solid onto a medium having a roughness of 0.05 microns to 1.5 microns Ra to form a coating solid layer.

2. The ink-jet printer of claim 1, wherein the medium is an intermediate transfer drum or belt and the ink is jetted onto the intermediate transfer drum or belt.

3. A method of printing within a printer, comprising:

applying a coating solid to a medium having a roughness of 0.05 microns to 1.5 microns Ra to form a layer of the coating solid, in a solid form, having predetermined thickness; said coating solid being a gel with a lamellar crystal structure, and applying ink toward the medium, wherein the layer of coating solid interacts with the applied ink to destabilize colorant in the ink.

4. The method of claim 3, wherein the medium is an intermediate transfer medium.

5. The method of claim 3, wherein the coating solid and ink are both applied to the medium, which is an intermediate transfer medium, and another medium is made to come into contact with the intermediate transfer medium to transfer the coating solid and ink to the other medium.

* * * * *